US005716314A

United States Patent [19]

Lauderbaugh

[11] Patent Number: 5,716,314

[45] Date of Patent: Feb. 10, 1998

[54] OPTIMAL ANGLE CORRUGATED BOARD FOLDER

[75] Inventor: David M. Lauderbaugh, Roswell, Ga.

[73] Assignee: Corrugated Gear & Services, Inc., Alpharetta, Ga.

[21] Appl. No.: 567,945

[22] Filed: Dec. 6, 1995

[51] Int. Cl.[6] ..... B31F 1/30

[52] U.S. Cl. ..... 493/441; 493/439; 493/440; 493/476; 493/479

[58] Field of Search ..... 493/69, 70, 71, 493/72, 178, 179, 356, 357, 358, 359, 360, 410, 416, 417, 418, 436, 441, 442, 443, 446, 450, 453, 454, 455, 468, 475, 476, 477, 478, 479, 439, 440

[56] References Cited

U.S. PATENT DOCUMENTS

| | | | |
|---|---|---|---|
| 1,838,704 | 12/1931 | Potdevin . | |
| 1,975,121 | 10/1934 | Potdevin . | |
| 2,346,191 | 4/1944 | Schultz . | |
| 2,701,989 | 2/1955 | Hayward . | |
| 2,887,313 | 5/1959 | Malott, Jr. | 270/86 |
| 3,266,391 | 8/1966 | Lopez | 93/52 |
| 3,389,645 | 6/1968 | Winters et al. | 93/44 |
| 3,535,987 | 10/1970 | Schafer | 93/52 |
| 3,610,114 | 10/1971 | Kaminsky | 93/52 |
| 3,668,369 | 6/1972 | Howe | 219/243 |
| 3,797,371 | 3/1974 | Randle | 93/52 |
| 3,992,982 | 11/1976 | Huskies | 93/52 |
| 4,055,110 | 10/1977 | Graham | 93/49 |
| 4,187,769 | 2/1980 | Bullock | 93/52 |
| 4,279,611 | 7/1981 | Labombarde et al. | 493/418 |
| 4,342,182 | 8/1982 | Dennis et al. | 53/156 |
| 4,528,053 | 7/1985 | Auer | 493/179 |
| 4,559,030 | 12/1985 | Tada | 493/454 |
| 4,624,653 | 11/1986 | McBride et al. | 493/127 |
| 4,701,156 | 10/1987 | Larsonneur | 493/418 |
| 4,741,728 | 5/1988 | Bakx | 493/178 |
| 4,871,347 | 10/1989 | Brinkmeier | 493/302 |
| 5,036,970 | 8/1991 | Fastner | 198/811 |
| 5,092,827 | 3/1992 | McAdam | 493/179 |
| 5,108,017 | 4/1992 | Adamski | 493/418 |
| 5,114,393 | 5/1992 | Vettorato | 493/193 |
| 5,137,505 | 8/1992 | Ishii | 493/248 |
| 5,152,738 | 10/1992 | Zehender | 493/440 |
| 5,334,128 | 8/1994 | Carico | 493/439 |
| 5,435,802 | 7/1995 | Kober | 493/418 |
| 5,556,360 | 9/1996 | Kober | 493/23 |

FOREIGN PATENT DOCUMENTS

| | | |
|---|---|---|
| 798194 | 5/1936 | France . |
| 475029 | 11/1937 | United Kingdom . |

*Primary Examiner*—Joseph J. Hail, III
*Assistant Examiner*—Christopher W. Day
*Attorney, Agent, or Firm*—Jones & Askew

[57] ABSTRACT

A corrugated board folder is disclosed for folding the flap of a corrugated board onto the base of the corrugated board along a fold line having an inside fold line and an outside fold line. The corrugated board folder includes a conveyor mounted on a frame for supporting the corrugated board during folding and a series of rollers that engage the flap of the corrugated board. Each roller in the series of rollers is supported adjacent the conveyer by a roller bracket. The roller has an axis which pivots about a bracket pivot point of the roller bracket. The bracket pivot point for each bracket is aligned with the inside fold line of the corrugated board and each roller is angularly positioned to squarely engage the flap of the corrugated board.

8 Claims, 5 Drawing Sheets

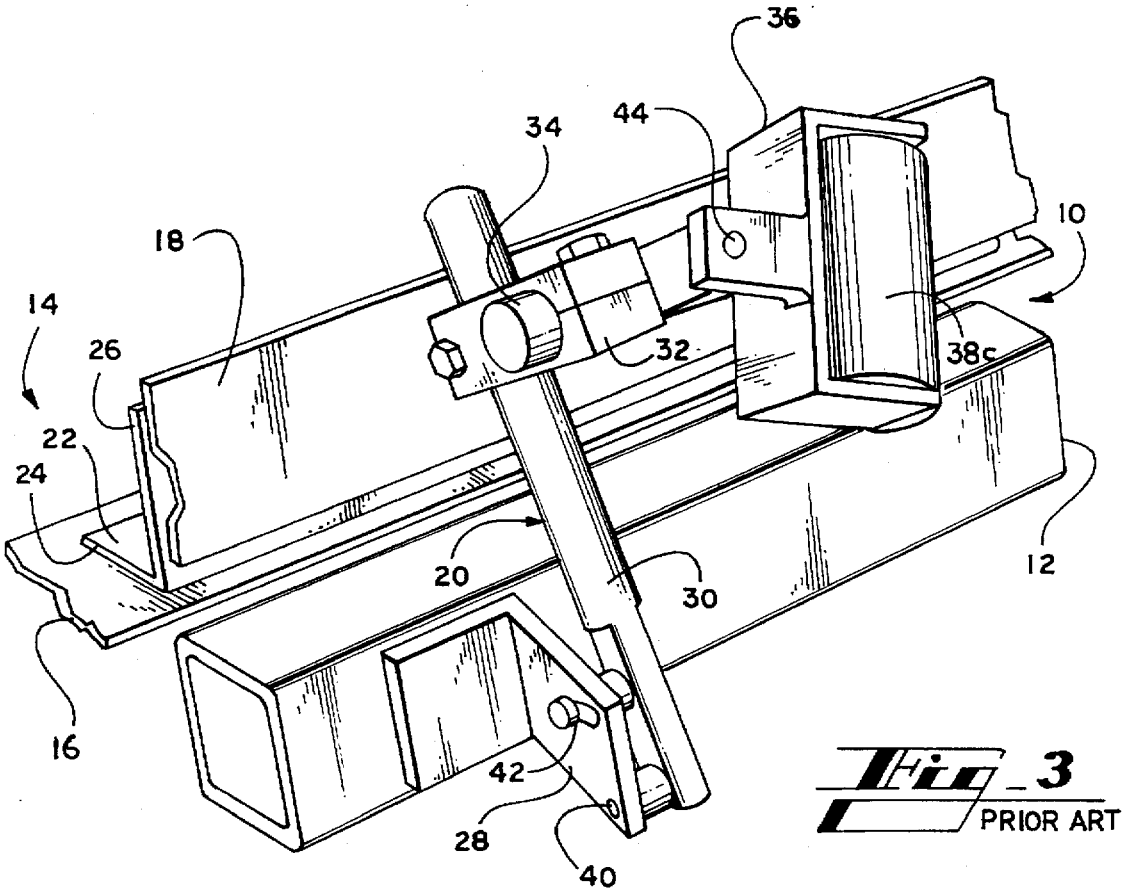
Fig_3
PRIOR ART
Fig_4
PRIOR ART
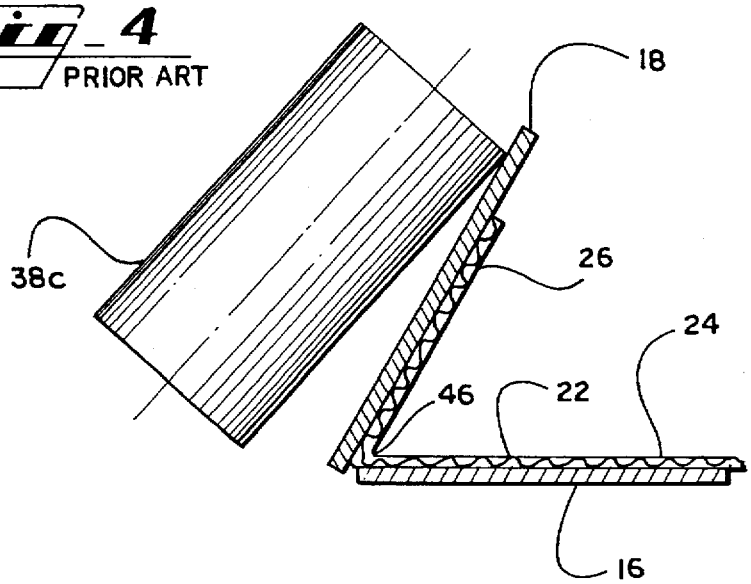

OPTIMAL ANGLE CORRUGATED BOARD FOLDER

TECHNICAL FIELD

The present invention relates generally to the corrugated board industry, and relates more specifically to a series of folding rollers for folding a corrugated board smoothly along a fold line.

BACKGROUND OF THE INVENTION

In the corrugated board industry, corrugated board is manufactured by adhering a corrugated, or fluted, sheet of paper to one or more flat sheets. The fluted sheet is referred to as a "medium", and the flat sheet is referred to as a "liner". The corrugated board consisting of the medium adhered to a single liner is referred to as "single ply corrugated board", "single ply board", or simply "single ply". By applying an additional liner to the other side of the medium, "double ply corrugated board", "double ply board", or "double ply" is formed. Single ply board is often used in packing fragile objects such as china and glass. Double ply board is often used in creating packaging products such as corrugated boxes and cases.

In connection with producing corrugated boxes and cases, it is often necessary to fold the flap of a double ply corrugated board along a fold line onto a base of the double ply corrugated board in order to produce a double thickness of double ply corrugated board. Such a flap folding operation is shown schematically in FIGS. 1 and 2. In a conventional flap folding operation, corrugated board 22 is carried by means of a conveyor 14 consisting of two conveyor belts 16 and 18. One of the conveyor belts, base conveyor 16, supports base 24 of the corrugated board 22 and the other conveyor belt, flap conveyor 18, supports flap 26 of the corrugated board 22 at approximately 90° to the base of the corrugated board. A series of rollers, 38*a* through 38*e* in FIG. 1, positioned along the edge of the base conveyor 16 engages the flap conveyor 18 on the side opposite the flap 26. As shown in FIGS. 2*a* through 2*e*, the rollers, 38*a* through 38*e*, in the series of rollers are progressively oriented at an angle from the first roller 38*a* which engages the flap conveyor 18 with the flap 26 in its upright position to the final roller 38*e* which holds the flap conveyor 18 and therefore the flap 26 down in the double over position on top of the base 24 of the corrugated board 22. As the flap conveyor 18 moves past the series of rollers, the series of rollers folds the flap 26 from its upright position (FIG. 2*a*) along an inside fold line 46 to a double over position on top of the base 24 of the corrugated board 22 (FIG. 2*e*).

In order to insure that the corrugated board does not buckle adjacent the inside fold line 46 during folding, each of the rollers, 38*a* through 38*e*, in the series of rollers must squarely engage the flap conveyor 18 along the entire width of the flap conveyor 18. FIGS. 2*i* through 2*e* show schematically the proper square engagement of the folding rollers 38*a* through 38*e* with the flap conveyor 18.

If a corrugated box folder is set up to fold only one type and size of box or case, each of the rollers in the series of rollers, through trial and error, may be set to a permanent position so that each roller engages the flap conveyor squarely along the entire width of the flap conveyor as shown in FIGS. 2*a* through 2*e*. Most corrugated board folders, however, are designed to fold a number of different boxes having variation of flap sizes and thicknesses. Before the corrugated board folder can accommodate a box of a different size with a corrugated board of different thickness, the series of rollers must be set for that particular size of box and thickness of corrugated board. Depending on the size of the box and the thickness of the corrugated board, the rollers may have to be spaced differently and oriented at different angles so that the folding may be achieved more gradually or less gradually than the previous set up for the corrugated board folder.

U.S. Pat. No. 4,871,347 discloses a bracket which allowed three dimensional arrangement and positioning of the folding rollers relative to a web material being folded. The three dimensional adjustable bracket includes several different adjustment points so that the folding roller can be positioned at a number of different orientations. By adjusting each of these points, it is possible for each of the rollers along the folding line of the web folder to be manipulated through trial and error to the proper position and orientation.

Another prior art corrugated board folder 10 is shown in FIG. 3. The corrugated board folder 10 comprises a frame 12 on which is mounted conveyor 14 consisting of base conveyor 16 and flap conveyor 18. Corrugated board 22 to be folded consists of base 24 and flap 26. The base 24 of the corrugated board 22 is carded by the base conveyor 16, and the corrugated board flap 26 is carried by the flap conveyor 18. The corrugated board folder 10 also includes a series of folding rollers, of which one roller 38*c* is shown in FIGS. 3 and 4. Each roller, such as 38*c*, is part of a folding roller assembly 20 which is connected to frame 12. The folding roller assembly 20 comprises L-shaped bracket 28 welded to frame 12, pivot arm 30, slide member 32, telescoping rod and arm 34, roller holder 36, and roller 38. The roller 38 is positioned by means of the folding roller assembly 20 so that the roller 38 engages flap conveyor 18 which in turns supports the corrugated board flap 26.

As can be seen from FIG. 3, the pivot arm 30 pivots about pivot point 40 by means of bolt and slot assembly 42. In addition, slide member 32 slides along the length of pivot arm 30 and can rotate about the axis of pivot arm 30. The telescoping rod and arm 34 telescope from slide member 32 and rotate within slide member 32. In addition, the roller holder 36 can pivot about pivot point 44. Consequently, the folding roller assembly 20 of the prior art provides at least six degrees of freedom of movement in aligning the roller 38 squarely with the flap conveyor 18.

The numerous adjustments and the infinite number of positions make positioning the roller 38*c* difficult. An operator who sets up the folding roller assembly 20 may misalign the roller 38*c* in any number of ways including the alignment shown in FIG. 4. Where the roller 38*c* is aligned with the flap conveyor 18 as shown in FIG. 4, the flap 26 of the corrugated board 22 will likely buckle at some point between the inside fold line 46 and the end of flap 26. Misalignment of the roller 38 in another fashion may result in the base 24 of the corrugated board 22 buckling. When the flap 26 or the base 24 of the corrugated board 22 buckles, the corrugated board 22 may have to be rejected. Consequently, one can immediately appreciate the difficulty involved in adjusting one roller 38*c* using the prior art roller assembly 20. The difficulty of setting up a series of rollers, 38*a* through 38*e*, using the roller assembly 20 is even greater. If buckling occurs, the operator must first determine which roller in the series of rollers is misaligned and then correct that roller alignment without affecting the alignment of the other rollers. Such a set up for a corrugated board folder is done through trial and error with the resulting loss of production time and wasted corrugated board.

SUMMARY OF THE INVENTION

The present invention overcomes the disadvantages associated with the prior corrugated board folders described above. The corrugated board folder of the present invention flows from the discovery that the proper orientation for each folding roller in a series of folding rollers depends on the axis of each roller pivoting about a pivot point coinciding with the inside fold line of the corrugated board being folded. If each folding roller in a series of folding rollers pivots about a point different than the inside fold line of the corrugated board, the flap or the base of the corrugated board will likely buckle as the flap of the corrugated board is folded from an upright position to a doubled over position on top of the base of the corrugated board.

In order to implement that discovery, the corrugated board folder of the present invention has a series of brackets that support the series of rollers on the frame of the corrugated board folder along the edge of the corrugated board conveyor. Each roller is attached to each bracket so that the axis of the roller pivots about a bracket pivot point. When the bracket is correctly positioned for operation, the bracket pivot point is aligned with the inside fold line of the corrugated board being folded. With the bracket pivot point aligned with the inside fold line of the corrugated board, the roller can be pivoted about the bracket pivot point to squarely engage the flap conveyor, and therefore squarely engage the flap of the corrugated board.

In order to insure alignment of the bracket pivot point with the inside fold line of the corrugated board, an alignment guide is mounted on the bracket. The alignment guide includes a guide holder and an elongated guide rod with its axis aligned with a radius passing through the bracket pivot point. One end of the elongated rod is pointed. The elongated guide rod can be extended from the guide holder along the radius intersecting the bracket pivot point to contact the inside fold line of the corrugated board. When the pointed end of the elongated guide rod of the alignment guide coincides with the inside fold line of the corrugated board, the bracket pivot point is in alignment with the inside fold line of the corrugated board. In order to adjust the bracket for alignment between the bracket pivot point and the inside fold line of the corrugated-board for different thicknesses and sizes of corrugated board, the bracket is moveable vertically and horizontally. Once the bracket has been set vertically and horizontally and the elongated guide rod has been retracted into the guide holder, the roller bracket may be slid horizontally along the length of the conveyor in order to position the bracket and its roller in the proper spaced relationship between and among the other folding rollers in the series of rollers. Once the rollers in the series of rollers are spaced along the length of the conveyor and each is adjusted to the proper position for alignment of its bracket pivot point with the inside fold line of the corrugated board, each roller is progressively pivoted about the bracket pivot point and locked into its position against the flap conveyor to fold the flap from the upright position to the folded over position.

In order to assist the folding operation of the series of rollers, a source of compressed air is directed via a nozzle against the flap. The compressed air literally blows the flap toward its folded over position and relieves pressure on the folding rollers.

Accordingly it is an object of the present invention to provide a corrugated board folder having a series of folding rollers which are supported by means of a series of roller brackets so that the axis of each roller pivots about a bracket pivot point which is in alignment with the inside fold line of the corrugated board being folded.

It is a further object of the present invention to provide a corrugated board folder in which the roller bracket has a bracket pivot point, an arcuate groove centered at a radius from the bracket pivot point, and a lock for engaging the arcutate groove and holding the roller in a fixed angular orientation with respect to the bracket pivot point.

It is also an object of the present invention to provide a slide and lock assembly on the roller bracket which allows vertical and horizontal orientation of the roller bracket so that the bracket pivot point can be aligned with the inside fold line of the corrugated board.

It is also an object of the present invention to provide an alignment guide attached to the roller bracket which extends along a radius through the bracket pivot point and can be extended to indicate the position of the bracket pivot point with respect to the inside fold line of the corrugated board.

It is further an object of the present invention to provide a source for fluid or air directed at the flap in its upright position in order to assist the series of rollers in folding the flap from its upright position to its doubled over position.

These and other objects, features and advantages of the present invention will become apparent upon reading the following detailed description of the preferred embodiments of the invention, when taken in conjunction with the drawings and appended claims.

BRIEF DESCRIPTION OF THE DRAWINGS

The invention will now be described with reference to the accompanying drawings, which illustrate a preferred embodiment of the optimum angle corrugated board folder, falling within the scope of the appended claims, and in which:

FIG. 3 is a perspective view of a roller assembly of one of a series of folding rollers of the prior art;

FIG. 4 is a side elevation view showing how the prior art roller FIG. 3 engages a corrugated board;

DETAILED DESCRIPTION OF THE INVENTION

Figure 6:
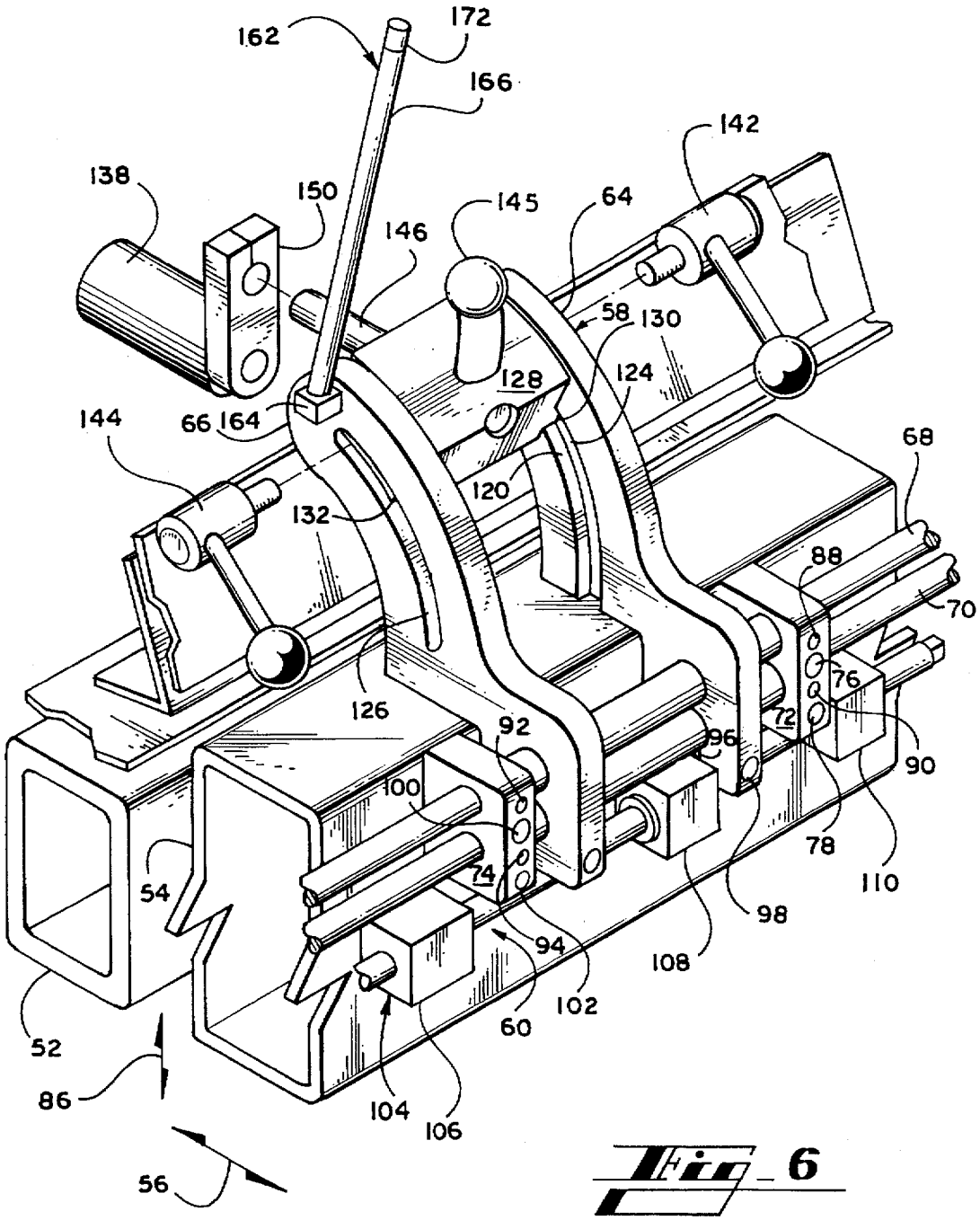
FIG. 6 is a perspective view of one roller and bracket of a series of rollers and brackets in accordance with the present invention for folding the flap of the corrugated board onto the base of the corrugated board.

Referring now in more detail to the drawings, in which like numerals indicate like parts throughout the several views, FIG. 6 shows a portion of a corrugated board folder 10 for folding a corrugated board 22 consisting of a flap 26 and a base 24 along a fold line 45. The fold line 45 is defined by an inside fold line 46 and an outside fold line 47. The corrugated board 22 to be folded is carried by a conveyor 14 consisting of a flap conveyor 18 and a base conveyor 16. The base conveyor 16 supports the base 24 of the corrugated board 22, and the flap conveyor 18 supports the flap 26 of the corrugated board 22.

The conveyor 14 is supported by a frame 12 which includes a base frame member 52 (FIG. 5) and a bracket support member 54 located adjacent the base frame member 52. The bracket support member 54 is moveable toward and away from the base frame member 52 in a horizontal direction as indicated by arrow 56. The bracket support member 54 is mounted at both ends to the base frame member 52 so that it can be locked in particular horizontal position along the horizontal direction indicated by arrow 56. Such support and locking is conventional and well known to those of ordinary skill in the art.

The flap conveyor 18 and the base conveyor 16 of conveyor 14 are both continuous belts. Each continuous belt is wrapped around a drive sprocket at one end and an idle sprocket at the opposite end. The sprockets are supported by frame 12 and are driven by suitable motors in a manner well known to those of ordinary skill in the art. The base conveyor 16 is supported along its length by the base frame member 52 in a manner well known to those of ordinary skill in the art.

Figure 1:
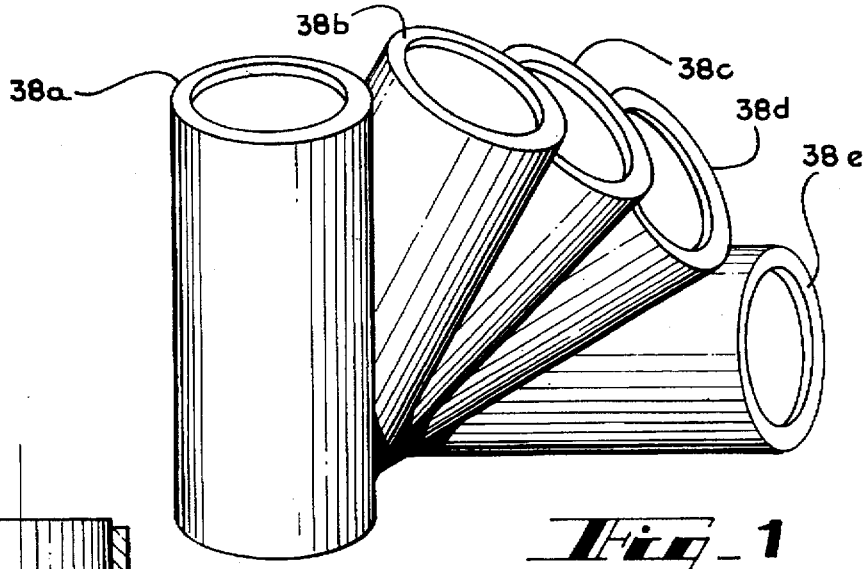
Fig 1 PRIOR ART
FIG. 1 is a perspective view of a series of rollers for folding a flap of a corrugated board onto a base of the corrugated board.
Figure 2A:
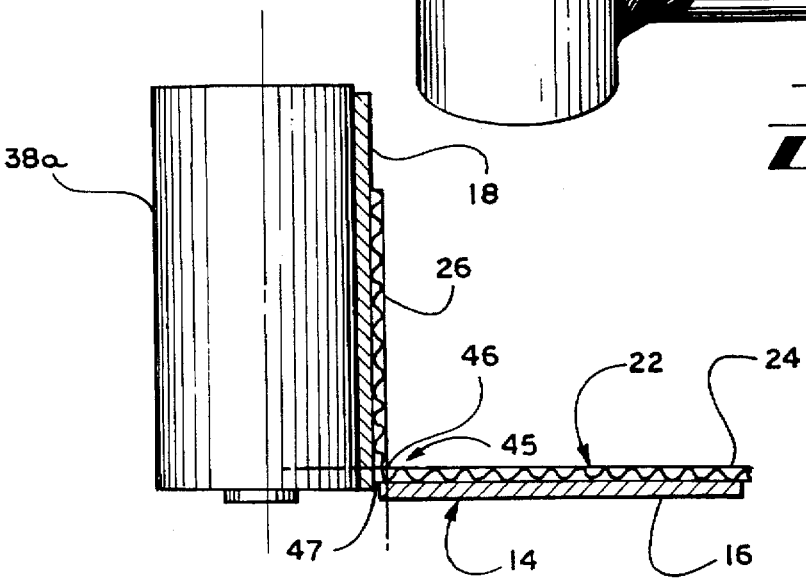
Fig 2A PRIOR ART
FIG. 2, consisting of FIGS. 2*a* through 2*e*, is a side elevation view showing how each of the rollers in the series of rollers of FIG. 1 engages and folds the flap of the corrugated board onto the base of the corrugated board.
Figure 2B:
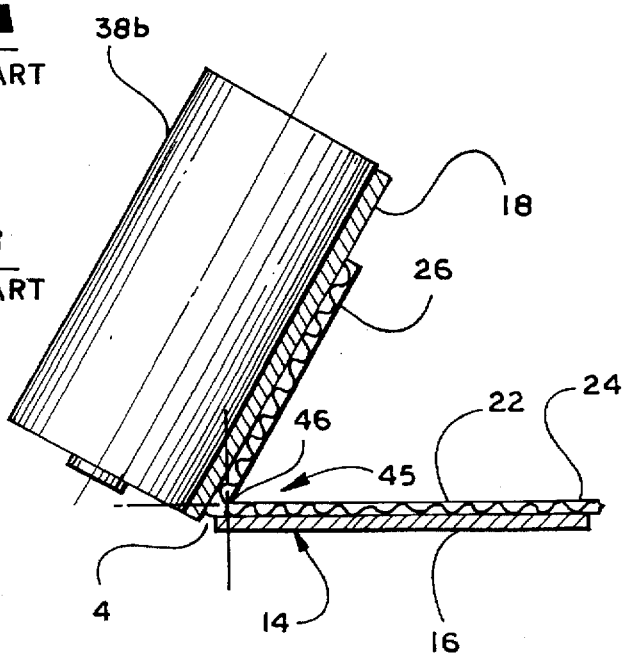
Fig 2B PRIOR ART
Figure 2C:
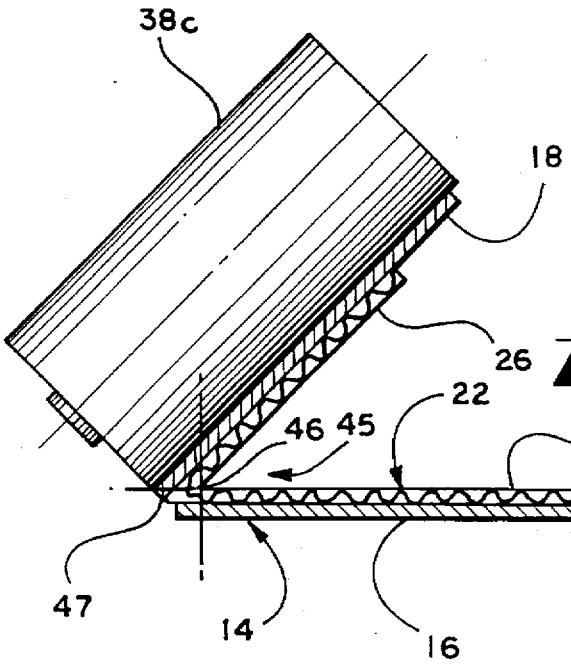
Fig. 2c PRIOR ART
Figure 2D:
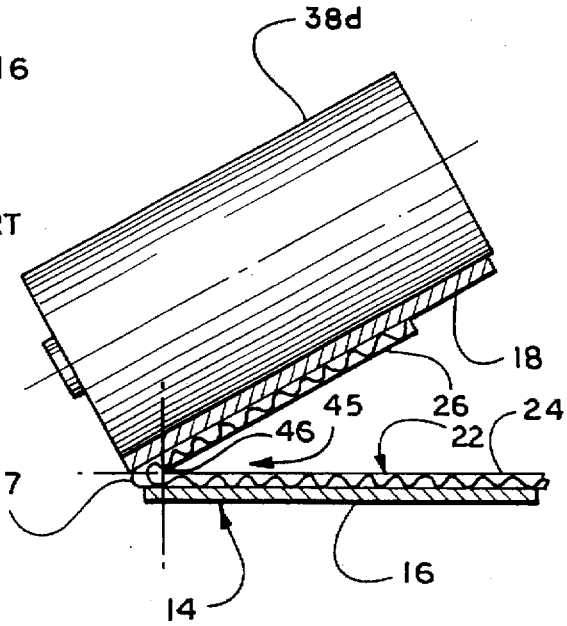
Fig. 2D PRIOR ART
Figure 2E:
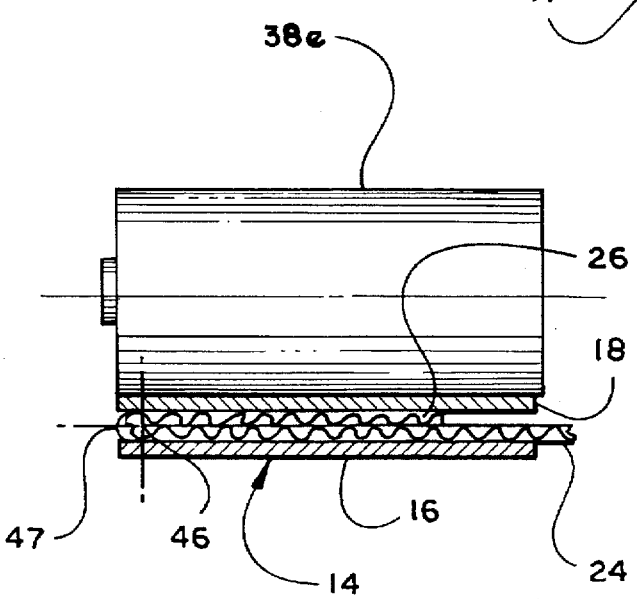
Fig. 2E PRIOR ART
Figure 5:
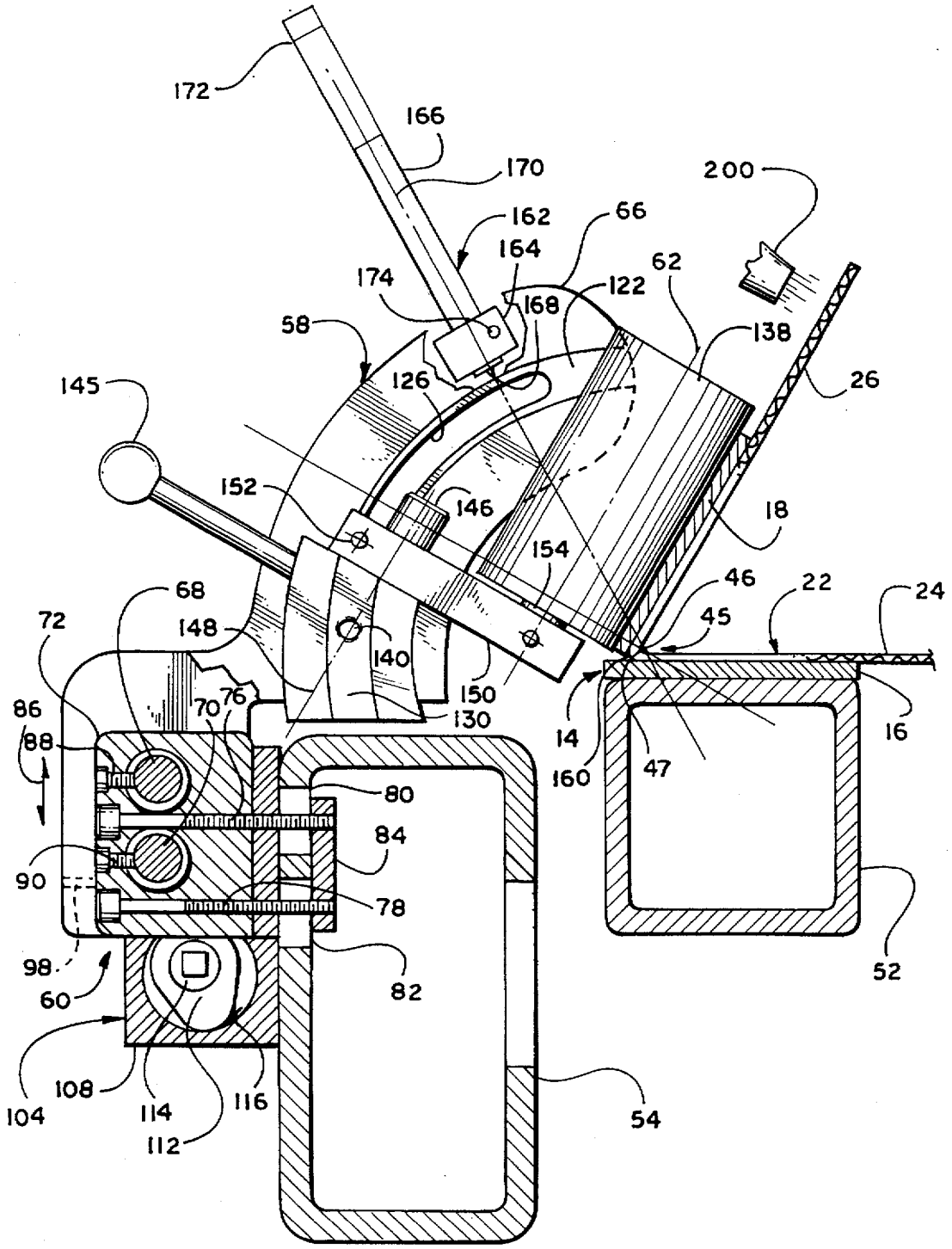
FIG. 5 is a side elevation view of one roller and bracket of a series of rollers and brackets in accordance with the present invention for folding the flap of the corrugated board onto the base of the corrugated board.

A roller bracket 58 is attached to bracket support member 54 by means of slide and lock assembly 60. The roller bracket 58 supports roller 138 having an axis 62. Roller bracket 58 and roller 138 are each one of several roller brackets and rollers that are mounted along the length of conveyor 14 for folding the flap 26 from an upright position as shown in FIG. 2*a* to a folded over position shown in FIG. 2*e*. FIG. 5 shows the roller 138 oriented at an angular position comparable to that shown schematically in FIG. 2*b*.

Bracket 58 comprises two arcuate shaped arms 64 and 66, slide block 128, rod 146, and spindle support member 150 (FIG. 6). The two arcuate shaped arms 64 and 66 are slidably supported on upper frame rod 68 and lower frame rod 67 of slide and lock assembly 60. The frame rods 70 and 68 are in turn supported on frame member 54 by means of frame blocks 72 and 74. The frame blocks .72 and 74 are slidably mounted on bracket support member 54 for vertical movement in the direction indicated by arrow 86 (FIG. 5).

As can best be seen in FIG. 5, frame block 72 is attached to bracket support member 54 by means of bolts 76 and 78 which extend through frame block 72 and through vertical slots 80 and 82 in bracket support member 54. The bolts 76 and 78 are threaded into keeper plate 84 within in bracket support member 54. Consequently, frame block 72 (and frame block 74) can be moved vertically as indicated by arrow 86 by loosening bolts 76 and 78 and sliding the frame block 72 within the confines of vertical slots 80 and 82 in bracket support member 54. As shown in FIG. 6, the support rods 68 and 70 are disposed within holes in frame blocks 72 and 74 and held in place by means of set screws 88, 90, 92, and 94.

Arcuate shaped arm 64 has a split 96 and bolt 98. When bolt 98 is loosened, arcuate arm 64 is free to slide along support rods 68 and 70. When bolt 98 is tightened, arcuate shaped arm 64 is clamped to support rods 68 and 70 so that it and arcuate arm 66 cannot slide in the horizontal direction along the length of the support rods 68 and 70.

The arcuate arms 64 and 66 are moved vertically as indicated by arrow 86 by moving the frame blocks 72 and 74 vertically with respect to the bracket support member 54. The frame blocks 72 and 74 can moved vertically by loosening bolts 76 and 78 for frame block 72 and bolts 100 and 102 for frame block 74 (FIG. 6). In order to move the frame blocks 72 and 74 up and down with respect to bracket support member 54 uniformly, a rod and eccentric assembly 104 is provided. The rod and eccentric assembly 104 includes fixed blocks 106, 108, and 110 (FIG. 6). The fixed blocks 106, 108, and 110 are screwed to the bracket support member 54. Each of the fixed blocks has a round hole drilled through it in a direction parallel to frame rods 68 and 70. A cam is disposed within each of the fixed blocks 106, 108, and 110. Turning to FIG. 5, cam 112, like identical cams disposed within blocks 106 and 110, is disposed within hole 116 of fixed block 108. The cam 112 is keyed to rod 114 so that it turns with the rotation of rod 114. As the rod 114 is turned, the cam 112 bears on the bottom of hole 116 of block 108 and thereby moves rod 114 upward. The cams in fixed blocks 106 and 110 likewise bear the rod 114 upward as the rod 114 is turned. Rod 114 contacts the bottom of blocks 72 and 74 and uniformly raises and lowers those blocks to thereby raise and lower frame rods 68 and 70 and with them arcuate shaped arms 64 and 66. Once the arcuate shaped arms 64 and 66 have been vertically positioned by means of the rod and eccentric assembly 104, the bolts 76 and 78 are tightened to lock the arcuate arms 64 and 66 in position.

Each of the arcuate shaped arms has an arcuate-shaped keyway and slot. Arcuate-shaped arm 64 has an arcuate-shaped keyway 120 and slot 124 (FIG. 6). Likewise, arcuate-shaped arm 66 has an arcuate-shaped keyway 122 and an arcuate-shaped slot 126 (FIG. 5). The arcuate-shaped keyways 120 and 122 and the arcuate-shaped slots 124 and 126 have a common center, bracket pivot point 160.

Slide block 128 has arcuate-shaped keys 130 and 132 and is positioned between arcuate-shaped arms 164 and 166. The arcuate-shaped key 130 of slide block 128 engages keyway 120, and arcuate-shaped key 132 of slide block 128 engages keyway 122 so that the slide block 128 can slide in an arcuate path along the arcuate keyways 120 and 122. Slide block 128 also has a threaded hole 140 through it in a direction parallel to the frame member 54. The threaded hole 140 is aligned with the keys 130 and 132 and with the slots 124 and 126 in the arcuate shaped arms 164 and 166. Locking bolts 142 and 144 engage threaded hole 140 at either end. When the locking bolts 142 and 144 are tightened, they bear against the outside of slots 124 and 126 and hold the slide block 128 securely between the arcuate-shaped arms 64 and 66. The slide block 128 has a handle 145 which is used in positioning the slide block along the arcuate-shaped keyways 120 and 122.

The slide block 128 has a roller support rod 146 extending from it. The roller support rod 146 has an axis 148 which at any given point along the arcuate shaped slots is perpendicular to a radius through bracket pivot point 160 (FIG. 5). A spindle support member 150 bearing spindle 154 is attached to rod 146 and secured by means of bolt 152 (FIG. 5). Roller 138 is mounted for rotation on spindle 154.

As previously explained, the center of arcuate-shaped keyways 120 and 122 and arcuate-shaped slots 124 and 126 is located at bracket pivot point 160. As shown in FIG. 5, bracket pivot point 160 also coincides with inside fold line 46 of corrugated board 22 when the roller 138 is properly aligned. Because bracket pivot point 160 is an imaginary point in space. It is necessary when setting up the roller 138 to be able to locate pivot point 160. In that regard, an alignment guide 162 comprising a guide holder 164 and an elongated guide rod 166 is attached to bracket 66. The elongated guide rod 166 has a pointed end 168. The elongated guide rod 166 has an axis 170 which is aligned with a radius that extends through bracket pivot point 160. Rod 166 also has an index 172. The elongated rod is held in the guide holder 168 by means of set screw 174. When the set screw 174 is loosened, the elongated guide rod 166 is extended through guide holder 164 until index 172 reaches the guide holder 164. At that point, the pointed end 168 of the elongated guide rod 160 is at the bracket pivot point 160.

In operation, the corrugated board folder 10 folds a corrugated board 22 along a fold line 45 defined by an inside fold line 46 and an outside fold line 47 (FIG. 5). The corrugated board folder 10 folds the corrugated board 22 as shown schematically in FIGS. 2*a* through 2*e*. In order to set up the series of rollers 38*a* through 38*e*, it is necessary to properly align each roller by means of roller bracket 58. Turning to FIG. 5, the alignment process begins for a particular roller, such as 138, by extending the elongated guide rod 166 through the guide holder 164 until the index 172 has aligned with the guide holder 164. With the index 172 has aligned with the guide holder 164, the point 168 of the elongated guide rod 166 coincides with the bracket pivot point 160. The point 168 of the alignment guide 162 and the bracket pivot point 160 are then aligned with the inside fold line 46 of the corrugated board 22 by moving the bracket support member 54 horizontally in the direction indicated by arrow 56 and moving the slide assembly 60 vertically in the direction indicated by arrow 86. Once the point 168 of the alignment guide 162 is aligned with inside fold line 46 of the corrugated board 22, the bracket support member 54 is locked in place horizontally and the slide assembly 60 is locked in place vertically. The elongated guide rod 166 may be then retracted into the guide holder 164.

With the bracket pivot point 160 aligned with the inside fold line 46 of the corrugated board 22, the bolts 142 and 144, which engage slide block 128, are loosened, and the operator grasps handle 145 in order to move slide block 128 along the arcuate-shaped keyways 120 and 122. The slide block 128 is moved in the keyways 120 and 122 until the roller 38*b* squarely engages the flap conveyor 18. Once the roller 38 has engaged the flap conveyor 18, bolts 142 and 144 are tightened thereby setting the roller at the desire angular position. Because the axis 62 of the roller 138 rotates about inside fold line 46, the roller 138 will be square against the flap conveyor 18, and the corrugated board will fold along fold line 45 without buckling.

In order to assist the rollers in folding the flap 26 along fold line 45, an air, such as air jet 200, is located adjacent each roller. The air jet 200 directs a stream of high pressure air against the flap 26 to force the flap 26 toward its folded over position.

It should be understood that numerous modifications or alternations may be made to the improved corrugating assembly without departing from the spirit and scope of the invention as set forth in the appended claims.

I claim:

1. A corrugated board folder comprising:

a. a frame;

b. a conveyor mounted on the frame for conveying a corrugated board including a base and a flap to be folded from an upright position to a doubled over position on the base along a fold line defined by an inside fold line and an outside fold line, the conveyor including a flap conveyor adjacent the flap and a base conveyor adjacent the base;

c. a series of roller brackets mounted along the frame, each roller bracket having an arcuate keyway with a shape of an arc having a center, the center being a bracket pivot point;

d. a series of slides corresponding to respective ones of the roller brackets, each slide slideably engaged within the arcuate keyway of a respective one of the roller brackets for selective movement along the respective one of the roller brackets;

e. a series of rollers corresponding to respective ones of the roller brackets, each roller having an axis and mounted to a respective one of the slides; and f. a series of locks for fixing the slides in a position on the respective roller brackets, wherein the rollers are mounted to the slides and the brackets are mounted to the frame such that the bracket pivot point of each keyway coincides with the inside fold line of the corrugated board, the axis of each roller at any point along the respective arcuate keyways is perpendicular to a radius through the inside fold line, and the rollers are positioned square against the flap conveyor, whereby each roller in the series can be arranged and locked in position about the inside fold line of the corrugated board to fold the flap of the corrugated board from the upright position to the doubled over position, without buckling the corrugated board, while the corrugated board is conveyed by the conveyor past the rollers.

2. The corrugated board folder of claim 1, wherein the folder further includes a source of pressurized air that is directed toward the flap for assisting the series of rollers in folding the flap from the upright position to the doubled over position.

3. The corrugated board folder of claim 1, wherein each roller is rotatably mounted to a spindle which is mounted on a spindle support bar connected to the respective slide.

4. A corrugated board folder comprising:

a. a frame including a base frame and a bracket support frame mounted to the base frame such that the bracket support frame is selectively movable toward and alternatively away from the base frame;

b. a frame lock for fixing the bracket support frame in a position relative to the base frame;

c. a conveyor mounted on the base frame for conveying a corrugated board including a base and a flap to be folded from an upright position to a doubled over position on the base along a fold line defined by an inside fold line and an outside fold line, the conveyor including a flap conveyor adjacent the flap and a base conveyor adjacent the base;

d. a series of roller brackets mounted along the bracket support frame and extending toward the conveyor, each roller bracket having an arcuate keyway with a shape of an arc having a center, the center being a bracket pivot point and the roller brackets being mounted to the bracket support frame such that the roller brackets can be selectively raised and alternatively lowered with respect to the bracket support frame and conveyor;

e. a roller bracket lock for fixing the roller brackets in a position relative to the bracket support frame;

f. a series of slides corresponding to respective ones of the roller brackets, each slide slideably engaged within the arcuate keyway of a respective one of the roller brackets for selective movement along the respective one of the roller brackets;

g. a series of rollers corresponding to respective ones of the roller brackets, each roller having an axis and mounted to a respective one of the slides; and h. a series of locks for fixing the slides in a position on the respective roller brackets, wherein the bracket support frame can be moved relative to the base frame and locked in position relative to the base frame, the roller brackets can be moved relative to the bracket support frame and the conveyor and locked in position relative to the bracket support frame, the slides can be moved along the arcuate keyways of the roller brackets relative to the conveyor and locked in position on the roller brackets such that the bracket pivot point of each keyway coincides with the inside fold line of the corrugated board, the axis of each roller at any point along the respective arcuate keyways is perpendicular to a radius through the inside fold line, the rollers are positioned square against the flap conveyor, and each roller in the series is arranged about the inside fold line of the corrugated board to fold the flap of the corrugated board from the upright position to the doubled over position, without buckling the corrugated board, while the corrugated board is conveyed by the conveyor past the rollers.

5. The corrugated board folder of claim 4, further comprising a series of alignment guides associated with respective roller brackets for indicating when the bracket pivot points of the respective bracket are aligned with the inside fold line of the corrugated board.

6. The corrugated board folder of claim 5, wherein each alignment guide comprises a guide holder mounted to the respective bracket and a guide rod having an axis and slideably engaged within the guide holder such that the axis of the guide rod is parallel to a radius of the arc of the respective bracket keyway, the guide rod having an end and an index spaced from the end a distance equal to the length of the radius of the arc of the respective bracket keyway.

7. The corrugated board folder of claim 4, wherein the folder further includes a source of pressurized air that is directed toward the flap for assisting the series of rollers in folding the flap from the upright position to the doubled over position.

8. The corrugated board folder of claim 4, wherein each roller is rotatably mounted to a spindle which is mounted on a spindle support bar connected to the respective slide.

* * * * *